US006253969B1

(12) United States Patent
Nelson et al.

(10) Patent No.: US 6,253,969 B1
(45) Date of Patent: Jul. 3, 2001

(54) DISPENSER FOR VISCOUS MATERIAL

(75) Inventors: Thomas Dean Nelson, Maplewood; Douglas Grinnell Anderson, St. Paul; Ross Austin Mackert, St. Louis Park, all of MN (US)

(73) Assignee: Ecolab Inc., St. Paul, MN (US)

( * ) Notice: Subject to any disclaimer, the term of this patent is extended or adjusted under 35 U.S.C. 154(b) by 0 days.

(21) Appl. No.: 09/433,999

(22) Filed: Nov. 4, 1999

(51) Int. Cl.[7] ..... B67D 5/00
(52) U.S. Cl. ..... 222/391; 222/43; 222/327
(58) Field of Search ..... 222/391, 386, 222/326, 327, 41, 43, 44

(56) References Cited

U.S. PATENT DOCUMENTS

| | | | | |
|---|---|---|---|---|
| 1,165,156 | * | 12/1915 | Davis | 222/391 |
| 2,086,462 | * | 7/1937 | Bost | 222/391 |
| 4,009,804 | * | 3/1977 | Costa et al. | 222/391 |
| 4,330,070 | * | 5/1982 | Doubleday | 222/43 |
| 4,444,560 | * | 4/1984 | Jacklich | 222/391 |
| 5,022,563 | | 6/1991 | Marchitto et al. | 222/327 |
| 5,197,635 | * | 3/1993 | Chang | 222/391 |
| 5,372,286 | * | 12/1994 | King | 222/391 |
| 5,433,352 | * | 7/1995 | Ronvig | 222/391 |
| 5,482,189 | * | 1/1996 | Dentler et al. | 222/391 |
| 5,595,327 | * | 1/1997 | Dentler et al. | 222/327 |

OTHER PUBLICATIONS

ActaDose™ Owner's Manual, 1993.
BaitGun Bruchure, 1997.
Maxforce Advertisement, 1998.
Bate Mate Advertisement, 1998.

* cited by examiner

*Primary Examiner*—J. Casimer Jacyna
(74) *Attorney, Agent, or Firm*—Mau & Krull, P.A.

(57) ABSTRACT

A housing has a first, dispensing end and a second, opposite end. A lever is squeezed against the housing to move a plunger toward the dispensing end. When fully squeezed, the lever extends parallel to the plunger and the longitudinal axis of the housing. The extent to which the plunger advances may be adjusted by relocating the pivot axis defined between the lever and the housing. A resilient washer is mounted on the shaft of the plunger and disposed behind a shoulder on the housing. The resilient washer deflects and/or stretches forward when the plunger advances, and urges the plunger rearward upon release of the lever.

19 Claims, 3 Drawing Sheets

DISPENSER FOR VISCOUS MATERIAL

FIELD OF THE INVENTION

The present invention relates to a dispenser suitable for conveniently and reliably dispensing a discrete amount of viscous material.

BACKGROUND OF THE INVENTION

Generally speaking, people recognize the need to dispense different types of materials under different types of circumstances. One useful type of dispenser is commonly known as a caulk gun. Generally speaking, the caulk gun has a plunger which pushes material out of a tube in response to pressure applied by a user against a trigger. Those skilled in the art will recognize that this so-called caulk gun arrangement is not limited to the application of caulk. For example, U.S. Pat. No. 5,022,563 to Marchitto et al. discloses a dispenser gun suitable for distributing insecticidal gels and/or pastes in a desired manner. Although beneficial in certain respects, the Marchitto et al. dispenser gun leaves room for improvement in other respects.

SUMMARY OF THE INVENTION

One aspect of the present invention is to provide a dispenser for viscous materials which is easy to handle and operate, particularly in connection with the application of insecticidal gels or pastes to insect harborage and travel areas. In this regard, the present invention provides a housing having a first, dispensing end, a second, opposite end, and a longitudinal axis extending therebetween. A plunger is movably mounted inside the housing to selectively advance the viscous material, and a lever is movably mounted on the housing to activate the plunger. The lever is positioned proximate the second end of the housing, and is connected to the plunger in such a manner that the plunger advances as the lever is squeezed against an adjacent portion of the housing and toward an orientation extending parallel to the longitudinal axis. On the preferred embodiment, the adjacent portion of the housing has a cross-section which is generally rectangular with rounded corners. The relatively longer dimension is measured perpendicular to the longitudinal axis and parallel to the plane traversed by the lever, and the relatively shorter dimension is measured laterally relative thereto. The housing and lever are configured so that a person can wrap his/her fingers about the housing with a thumb resting naturally on the lever and extending toward the dispensing end.

Another aspect of the present invention is to provide a dispenser for viscous materials which dispenses an adjustable quantity of material without requiring "touch" on the part of the user. In this regard, the present invention provides a dispenser having a first, dispensing end, a second, opposite end, and a longitudinal axis extending therebetween. A plunger is movably mounted inside the housing to selectively advance the viscous material, and a lever is movably mounted on the housing to activate the plunger. The lever pivots about a pin relative to the housing to advance the plunger. A screw is rotatably mounted on the housing and extends parallel to the longitudinal axis. The screw is threaded transversely through the pin and rotates relative to the housing to move the pin along the longitudinal axis, thereby changing the operational dynamics of the lever and its effect on the plunger. On a preferred embodiment, a pinion gear is mounted on a rearward end of the screw, and a ring gear is rotatably mounted on the housing and engaged with the pinion gear. The ring gear is rotated in order to turn the screw and change the axial location of the pin.

Yet another aspect of the present invention is to provide a dispenser for viscous materials which dispenses a discrete amount of material within a short and predictable amount of time. In this regard, the present invention provides a housing having a forward end and a rearward end. A plunger is movably mounted within the housing, and an operator is mounted on the housing to selectively advance the plunger forward relative to the housing. The plunger includes a shaft and a head, and a resilient washer is mounted snugly on the shaft and disposed immediately rearward of an overlapping shoulder on the housing. When the operator advances the plunger, the plunger moves forward relative to the housing and the washer, and an inward portion of the washer is deflected forward a lesser amount than the plunger. When the operator relaxes relative to the plunger, the washer urges the plunger rearward the lesser amount to contemporaneously relieve pressure applied by the head against the viscous material. On a preferred embodiment, a push plate, a coil spring, a steel washer and the resilient washer are disposed in series between relatively forward and rearward shoulders on the housing, and the lever bears against the push plate.

The present invention is designed to deliver a controlled, yet selectively variable amount of material in a convenient fashion. The preferred embodiment is designed specifically for use with insecticidal gels and/or pastes, but the present invention may be used with other types of viscous materials, including caulk, grease, and frosting, for example. Many of the features, advantages, and/or applications will become apparent from the more detailed description that follows.

BRIEF DESCRIPTION OF THE FIGURES OF THE DRAWING

With reference to the Figures of the Drawing, wherein like numerals represent like parts and assemblies throughout the several views.

DETAILED DESCRIPTION OF A PREFERRED EMBODIMENT

Figure 1:
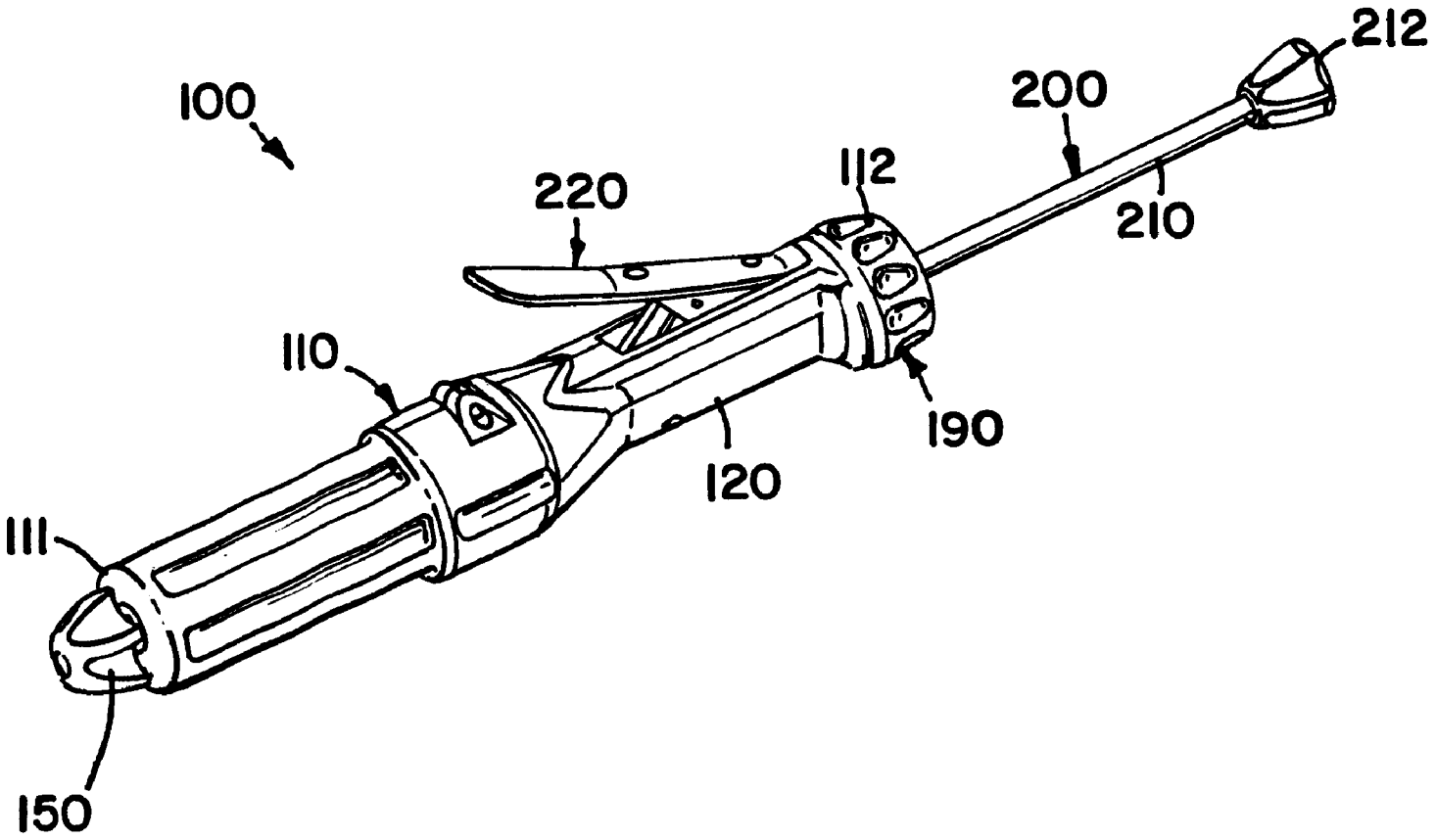
FIG. 1 is a perspective view of a preferred embodiment dispenser constructed according to the principles of the present invention.
Figure 2:
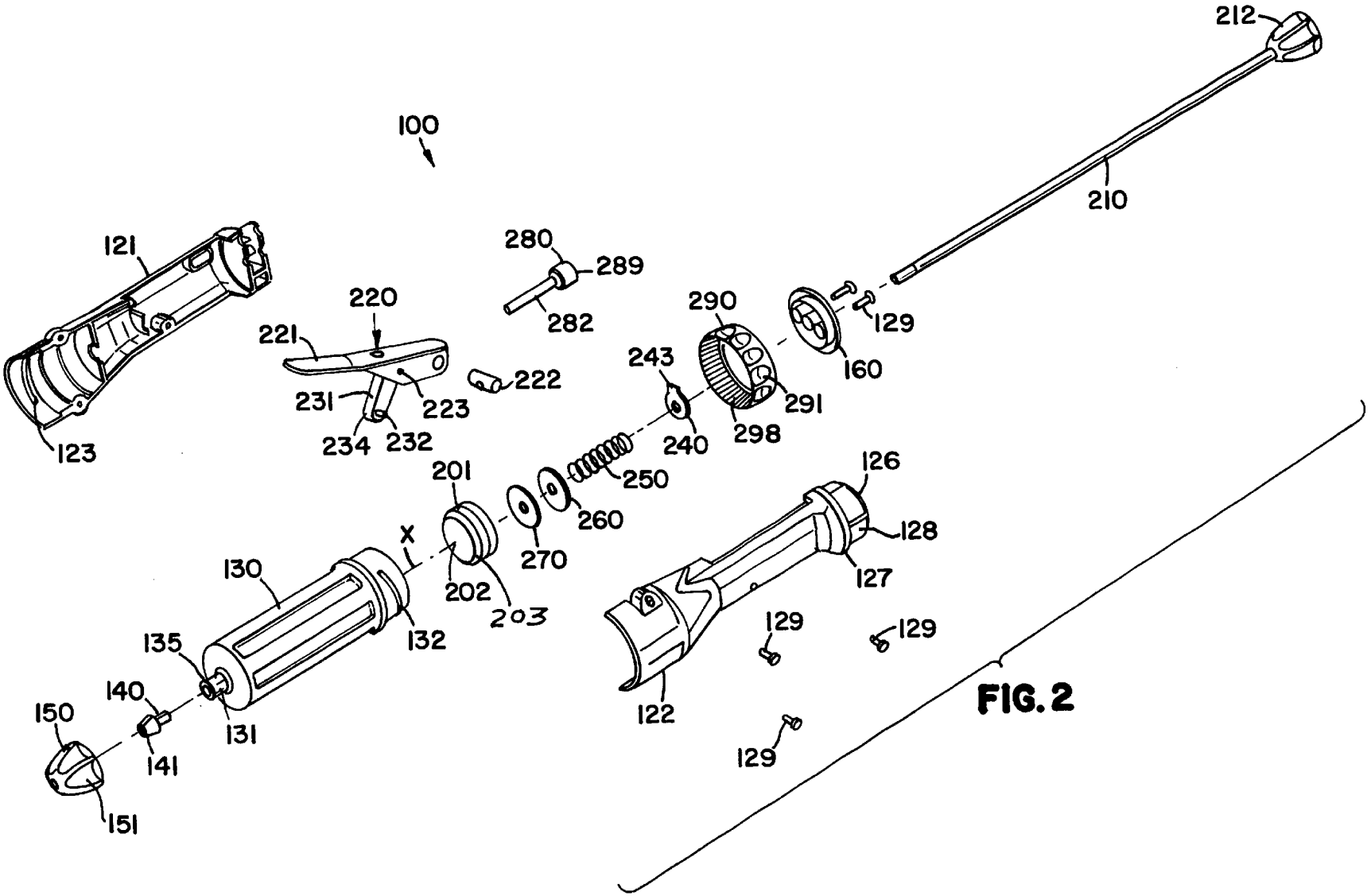
FIG. 2 is an exploded assembly view of the dispenser of FIG. 1.

A preferred embodiment dispenser constructed according to the principles of the present invention is designated as 100 in FIGS. 1–2. The dispenser 100 may be described generally in terms of a housing 110; a plunger 200 which moves relative to the housing 110 to dispense a viscous material from the housing 110; an operator or lever 220 which moves relative to the housing 110 to activate the plunger 200; and an adjusting means 190 for adjusting the extent to which the plunger 200 moves in response to an easily repeatable movement of the lever 220.

The housing 110 has a forward, dispensing end 111; an opposite, rearward end 112; and a longitudinal axis X extending therebetween. A rearward portion 120 of the housing 110 is sized and configured for grasping in a person's hand, and is comprised of complementary, opposite side parts 121 and 122 which are secured together by three screws 129. The handle portion of the housing 110 has a cross-section which may be described generally in terms of a rectangle having rounded corners. The side of the rectangle opposite the lever 220 (the bottom side) is about three-quarters of an inch long. The left and right sides of the rectangle are about one and three-eighths inches long and may be described as outwardly convex (with the outermost points about twice as far from the bottom side as the top side). The side of the rectangle which accommodates the lever 220 (the top side) is approximately one and one-eighth inches long.

The foregoing arrangement allows a person to wrap his/her fingers about the bottom side and at least one of the left side and the right side of the handle portion, with his/her thumb resting naturally on the lever 220. The thumb may rest across the lever 220 or extending axially along the lever 220. In the alternative, a person may prefer to hold the dispenser 100 in an "inverted" orientation with his/her fingers spanning the lever 220. In either case, the lever 220 defines an angle between ten and thirty degrees relative to the top side of the housing 110 when in a "ready" position, and the lever 220 may be comfortably squeezed against the housing 110. When fully depressed, the lever 220 extends parallel to the top side (or bottom side) of the housing 110 (and parallel to the longitudinal axis X).

Each of the portions 121 and 122 has an open forward end with internal threads 123 disposed about the sidewalls for reasons explained below. Each of the portions 121 and 122 has a closed rearward end 126 which is secured to a common end cap 160 by means of two screws 129. A relatively smaller diameter section 128 of the housing 110 is defined between the end cap 160 and an outwardly projecting flange 127 on each of the portions 121 and 122. A ring 290 is rotatably mounted on this section 128 and retained in place by the end cap 160.

A forward portion of the housing 110 is comprised of a tubular member 130 having a forward end which terminates in a nozzle or tip 131, and a rearward end which is provided with external threads 132. The rearward end of the tubular member 130 is sized and configured for insertion into the forward end of the rearward housing portion, and the threads 132 are sized and configured to interengage the threads 123. The threads 132 and 123 are configured in saw tooth fashion to resist unintentional unscrewing of the two portions. The tubular member 130 screws into the rearward housing portion until the leading edge of the tubular member 130 encounters inwardly projecting shoulders 113 on the housing portions 121 and 122.

A bore extends axially through the tip 131. At the juncture between the tip 131 and the main body of the tubular member 130, a circumferential shoulder extends radially inward to reduce the diameter of the bore. A collet 140 is inserted into the bore in the tip 131 until its leading edge encounters the inwardly extending shoulder. A rearward portion of the collet 140 has a cylindrical sidewall, and a forward portion of the collet 140 has a conical sidewall 141. Axially extending slits extend entirely through the conical sidewall 141 and partially into the cylindrical sidewall.

The tip 131 is provided with external threads 135 which are sized and configured to mate with internal threads on a collet nut 150. A bore extends axially through the collet nut 150 and has a conical sidewall which is forwardly converging. The collet nut 150 fits over the collet 140 and threads onto the tip 131. The internal sidewall of the collet nut 150 bears against the conical sidewall portions 141 of the collet 140, thereby narrowing the internal diameter defined therebetween. An inwardly projecting lip is provided at the forward end of the collet nut 150 to overlap the leading edges of the conical sidewall portions 141. Flanges 151 are provided on the outside of the collet nut 150 to facilitate manipulation thereof.

The tubular member 130 is sized and configured to receive a cylindrical tube of viscous material. The tube includes a cylindrical sidewall and caps or plugs inserted into opposite ends thereof. The plugs are removed before the tube is inserted into the tubular member 130, although a movable barrier may be left inside the rearward end of the tube (between the viscous material and the leading surface on the plunger 200). An internal, circular groove, centered about the longitudinal axis X, is provided in the forward end of the tubular member 130 to receive and register with the leading edge of the cylindrical sidewall on the tube of viscous material.

The plunger 200 includes a shaft 210 which extends through the housing portions 121 and 122; a grip 212 mounted on a rearward end of the shaft 210; and a head 201 mounted on an opposite, forward end of the shaft 210. The head 201 is sized and configured to insert snugly into the tube of viscous material and to apply pressure against the viscous material and/or a barrier disposed therebetween. The head 201 includes a leading surface or pushing surface 202 which extends perpendicular to the longitudinal axis X, and which may also be described as forwardly convex. The head 201 also includes a circumferential sidewall 203 which is centered about the longitudinal axis X, and which has forwardly diverging sidewalls spaced radially outward from the pushing surface 202. In other words, the sidewall 203 and the surface 202 cooperate to define an annular gap therebetween.

Figure 3:
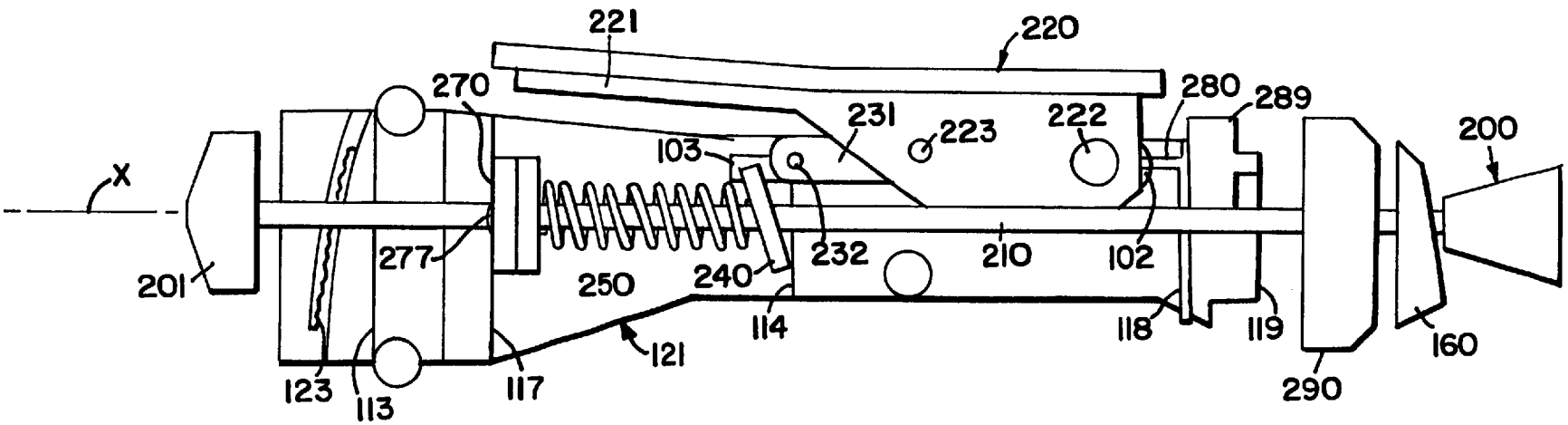
FIG. 3 is a diagrammatic, sectioned side view of most of the dispenser of FIG. 1.

A push plate 240, a helical coil spring 250, a fender washer 260, and a drag washer 270 are mounted in series on an intermediate portion of the plunger shaft 210. The push plate 240 may be described as a washer having a radially projecting tab 243. A hole extends through the push plate 240 to accommodate the plunger shaft 210. The hole has an internal diameter which is greater than the external diameter of the shaft 210. The push plate 240 has a thickness which is measured perpendicular to the diameter of the hole. The internal diameter of the hole in the push plate 240 is less than the sum of the external diameter of the shaft 210 and the thickness of the push plate 240. More specifically, the push plate 240 is sized and configured to grab the shaft 210 in response to an eccentric force applied against the tab 243 and subsequent tilting of the push plate 240 out of a plane extending perpendicular to the shaft 210 (as shown in FIG. 3).

The drag washer 270 is made of a resilient material, such as rubber. A hole extends through the drag washer 270 to accommodate the plunger shaft 210. The internal diameter of this hole is at least as small as the external diameter of the shaft 210 to ensure a snug, friction fit therebetween. The fender washer 260 and the spring 250 fit relatively more loosely about the plunger shaft 210. As shown in FIG. 3, the drag washer 270 is positioned immediately rearward of a circumferential shoulder 117 on the housing 110, and the push plate 240 is positioned immediately forward of a relatively more rearward wall 114 on the housing 110. The spring 250 is compressed therebetween together with the fender washer 260.

The fender washer 260 remains planar while transmitting or distributing the force of the spring 250 to the drag washer 270. The shoulder 117 is disposed about a central opening having an internal diameter which is approximately twice as large as the external diameter of the plunger shaft 210. As a result, a central portion 277 of the drag washer 270 is able to deflect and/or stretch forward as the plunger shaft 210 moves forward relative to the housing 110. However, in the absence of force applied against the lever 220, the drag washer 270 is inclined to remain relatively flat.

The lever or operator 220 includes a first member 221 and a second member 231 which are pivotally connected to one another by a pivot pin 223 (which extends perpendicular to the longitudinal axis X). A first end of the lever member 221 provides a smooth, gently contoured surface which is disposed outside the housing 110, and which is sized and configured to be squeezed inside a person's hand. An opposite, second end of the lever member 221 is pivotally mounted to an intermediate portion of a relatively larger diameter pivot pin 222 (which also extends perpendicular to the longitudinal axis X). opposing cavities 102 are provided in the housing portions 121 and 122 to receive opposite ends of the pivot pin 222. As a result of this arrangement, the first lever member 221 pivots about pin 222 relative to the housing 110, and the second lever member 231 pivots about pivot pin 223 relative to the first lever member 221.

A roller or bearing member 234 is rotatably mounted on a translating end of the second lever member 231 by means of a guide pin 232. Opposing cavities 103 are provided in the housing portions 121 and 122 to receive opposite ends of the guide pin 232. As a result of this arrangement, the guide pin 232 and the bearing member 234 are constrained to travel along the path defined by the cavities 103 in response to pivoting of the lever 220.

The components of the lever and plunger assemblies are sized, configured, and arranged in such a manner that the bearing member 234 bears against the tab 243 on the push plate 240 when the first lever member 221 occupies the position shown in FIG. 1. As a result, when the first lever member 221 is squeezed toward the housing 110 (to arrive at the position shown in FIG. 3), the bearing member 234 pushes the tab 243 forward, causing the push plate 240 to both rotate and drive the plunger shaft 210 forward. When the first lever member 221 is released, the spring 250 urges the push plate 240 back into parallel alignment with the housing wall 114 (and returns the lever 220 upward to the position shown in FIG. 1), and the drag washer 270 urges the plunger shaft 210 rearward. The rearward travel of the plunger shaft 210 is less than the forward travel that preceded it, and is intended to remove pressure from the viscous material being dispensed, thereby promptly terminating the dispensation of the viscous material.

The opposing cavities 102 in the housing 110 allow the position of the pivot pin 222 to be adjusted relative to the housing 110, thereby changing the extent of forward plunger movement caused by complete depression of the lever 220. In this regard, a screw 280 is rotatably mounted on the housing 110 between walls 118 and 119. A threaded end 282 of the screw 280 is threaded transversely through the pivot pin 222, and the screw 280 determines the position of the pivot pin 222 and provides the reactionary force associated with operation of the lever 220. Rotation of the screw 280 causes the pivot pin 222 to travel along the axis of the screw 280 (and along the cavities 102). On the preferred embodiment 100, a pinion gear 289 is mounted on a rearward end of the screw 280. The pinion gear 289 has external threads which mate with internal threads 298 on the ring 290. As a result, rotation of the ring 290 relative to the housing 110 is linked to rotation of the screw 280 relative to the housing 110. The ring 290 is provided with outwardly extending flanges 291 which facilitate rotation thereof.

When the ring 290 is rotated in a first direction, the pivot pin 222 moves forward, and the stroke of the lever 220 is relatively greater. Conversely, when the ring 290 is rotated in a second, opposite direction, the pivot pin 222 moves rearward, and the stroke of the lever 220 is relatively smaller. Indicia may be provided on the end cap 160 to indicate the effect of rotating the ring 290 in each direction. Also, circumferentially spaced ridges and depressions may be provided on the end cap 160 and the ring 290, respectively, to provide intermittent signals as to the extent of rotation.

To the extent that it may contribute to the disclosure and/or understanding of the present invention, U.S. Pat. No. 5,022,563 to Marchitto et al. is incorporated herein by reference. Also, the present invention should be interpreted in view of the preferred embodiment and specific application described above, but should not be limited thereto. For example, the preferred embodiment is a manually operated dispenser, but the drag washer assembly and/or the adjustment assembly may be implemented on more sophisticated dispensing systems, as well. In this regard, the term operator should be construed broadly to include both hand operated members, such as a lever, and/or driven members, such as a linear actuator. Recognizing that this disclosure will enable those skilled in the art to devise additional improvements, modifications, and/or applications which nonetheless incorporate the essence of the present invention, the scope of the present invention is to be limited only to the extent of the following claims.

What is claimed is:

1. A dispenser for a viscous material, comprising:

a housing having a forward end and a rearward end;

a plunger movably mounted within the housing, wherein the plunger includes a shaft and a head;

an operator mounted on the housing and operatively connected to the plunger to selectively advance the plunger forward relative to the housing; and a resilient washer mounted snugly on the shaft and disposed immediately rearward of an overlapping shoulder on the housing, whereby when the operator advances the plunger, the plunger moves forward relative to the housing and the washer, and an inward portion of the washer is deflected forward a lesser amount than the plunger, and when the operator is free of externally applied force, the washer urges the plunger rearward the lesser amount to contemporaneously relieve pressure applied by the head against the viscous material.

2. The dispenser of claim 1, wherein a helical coil spring is compressed between the resilient washer and a portion of the housing disposed rearward of the shoulder.

3. The dispenser of claim 2, wherein a push plate is mounted on the shaft and disposed between the spring and the portion of the housing disposed rearward of the shoulder, and the push plate defines an inside diameter and has a thickness measured perpendicular to the inside diameter, and the shaft defines an outside diameter, and the inside diameter is greater than the outside diameter and less than the outside diameter plus the thickness.

4. The dispenser of claim 3, wherein the operator bears against a tab on the push plate, tilts the push plate into driving engagement with the shaft, and pushes the push plate forward together with the plunger.

5. The dispenser of claim 1, further comprising means for adjusting how far forward the plunger advances in a single cycle.

6. The dispenser of claim 1, further comprising:

the housing having a handle portion proximate the rearward end; and a longitudinal axis extending between the forward end and the dispensing end;

the operator, further comprising a lever movably mounted on the housing, adjacent the handle portion, and operatively connected to the plunger in such a manner that the plunger advances as the lever is squeezed against the handle portion and toward an orientation extending parallel to the longitudinal axis.

7. The dispenser of claim 1, wherein the housing has a relatively smaller cross-sectional area, extending perpendicular to the longitudinal axis, at the handle portion, and a relatively larger cross-sectional area, extending perpendicular to the longitudinal axis, elsewhere along the housing.

8. The dispenser of claim 7, wherein the smaller cross-sectional area is generally rectangular with rounded corners, and the lever extends through an opening in one of two relatively shorter sides of the smaller cross-sectional area.

9. The dispenser of claim 8, wherein the handle portion is contoured to accommodate a person's fingers wrapped about two adjacent sides of the handle portion, including an opposite one of the two relatively shorter sides, and extending circumferentially about the longitudinal axis, and to accommodate a person's thumb on top of the lever.

10. The dispenser of claim 1, wherein the handle portion is contoured to accommodate a person's fingers wrapped partially circumferentially about the handle portion, including a side opposite the lever, and to accommodate a person's thumb on top of the lever.

11. A dispenser for a viscous material, comprising:

a housing having a forward, dispensing end and an opposite, rearward end;

a plunger movably mounted within the housing, wherein the plunger includes a shaft and a head;

a lever mounted on the housing and operatively connected to the plunger to selectively advance the plunger forward relative to the housing; and a means mounted on the housing for adjusting how far forward the plunger advances in response to a single operation of the lever, wherein the means includes a screw rotatably mounted on the housing and threaded transversely through a pin which pivotally mounts the lever to the housing.

12. The dispenser of claim 11, wherein a single operation of the lever moves the plunger forward a first amount when the pin occupies a first position relative to the housing, and a single operation of the lever moves the plunger forward a second, relatively greater amount when the pin occupies a second, relatively forward position relative to the housing.

13. The dispenser of claim 11, wherein the means further includes a ring rotatably mounted on the housing, and a pinion gear is mounted on an end of the screw, and interengaging gear teeth are provided on the pinion gear and the ring to link rotation of the ring relative to housing to rotation of the screw relative to the housing.

14. The dispenser of claim 13, wherein the shaft and the housing extend through the ring.

15. A dispenser for a viscous material, comprising:

a housing having a forward, dispensing end; an opposite, rearward end; and a longitudinal axis extending therebetween;

a plunger movably mounted within the housing, wherein the plunger includes a shaft and a head;

a resilient washer mounted snugly on the shaft and disposed immediately rearward of an overlapping shoulder on the housing;

a lever mounted on the housing and operatively connected to the plunger to selectively advance the plunger forward relative to the housing, wherein the lever pivots about a pin relative to the housing and pivots toward a parallel orientation relative to the longitudinal axis to advance the plunger;

a screw rotatably mounted on the housing and extending parallel to the longitudinal axis, wherein the screw is threaded transversely through the pin and rotates relative to the housing to move the pin along the longitudinal axis.

16. The dispenser of claim 15, wherein a pinion gear is rigidly mounted on an end of the screw opposite the pin, and a ring gear is rotatably mounted on the housing proximate the rearward end, and interengaging gear teeth are provided on the ring gear and the pinion gear.

17. The dispenser of claim 15, wherein the lever includes a first member which is pivotal about the pin, and a second member having a first end pivotally connected to the first member, and a second end which bears against a push plate on the shaft.

18. The dispenser of claim 17, wherein the housing is configured to guide the second end of the second member along a linear path extending parallel to the longitudinal axis.

19. The dispenser of claim 15, wherein the head of the plunger has a primary pushing surface which extends perpendicular to the longitudinal axis, and a circumferential rim which surrounds the head and flares radially outward toward the forward end of the housing, and an annular gap is defined between the pushing surface and a forward most portion of the rim.

* * * * *